US006299270B1

(12) United States Patent
Merrill

(10) Patent No.: US 6,299,270 B1
(45) Date of Patent: Oct. 9, 2001

(54) INK JET PRINTING APPARATUS AND METHOD FOR CONTROLLING DROP SHAPE

(75) Inventor: Kyle John Merrill, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/228,883

(22) Filed: Jan. 12, 1999

(51) Int. Cl.[7] ..... B41J 29/38; B41J 2/14; B41J 2/05

(52) U.S. Cl. ..... 347/9; 347/47; 347/56

(58) Field of Search ..... 347/9, 20, 37, 347/39, 40, 47, 56

(56) References Cited

U.S. PATENT DOCUMENTS

| | | | |
|---|---|---|---|
| 4,794,411 | 12/1988 | Taub et al. | 347/47 |
| 4,967,208 | 10/1990 | Childers | 347/56 |
| 5,369,428 | 11/1994 | Maze et al. | 347/5 |
| 5,373,368 * | 12/1994 | Taniguro | 358/296 |
| 5,453,767 | 9/1995 | Chang et al. | 347/10 |
| 5,461,406 | 10/1995 | Lorenze, Jr. et al. | 347/65 |
| 5,992,968 | 11/1999 | Uetsuki et al. | 347/37 |
| 6,062,666 * | 5/2000 | Omata et al. | 347/12 |
| 6,126,282 * | 10/2000 | Oikawa | 347/101 |

FOREIGN PATENT DOCUMENTS

| | | | |
|---|---|---|---|
| 0400263A2 | 8/1991 | (EP) | B41J/2/16 |
| 0858896A2 | 8/1998 | (EP) | B41J/2/205 |
| 7197384 | 8/1995 | (JP) | D06P/5/00 |
| 8080612 | 3/1996 | (JP) | B41J/2/05 |

* cited by examiner

*Primary Examiner*—John Barlow
*Assistant Examiner*—Alfred E Dudding

(57) ABSTRACT

A method of ink jet printing including positioning an ink jet print head having a number of nozzles adjacent a sheet of printer media, and moving the sheet or the print head along a scan axis. An ink droplet is expelled from one of the nozzles in an ejection direction offset from perpendicular to the scan axis. The droplet may have a main portion and a tail portion having different velocities and directions, with these parameters and the rate of scanning selected so that both portions strike the same location on the media sheet.

7 Claims, 5 Drawing Sheets

INK JET PRINTING APPARATUS AND METHOD FOR CONTROLLING DROP SHAPE

FIELD OF THE INVENTION

This invention relates to ink jet printing, and more particularly to high speed ink jet printing.

BACKGROUND AND SUMMARY OF THE INVENTION

Ink jet printers have proven effective for many printing purposes. It is an ongoing goal to increase the printing speed for most printers, including ink jet printers. It is also a goal to provide excellent image quality, such as by providing an image matrix having higher resolution, or more dots per inch (DPI). With ink jet printers, increased print speed may be provided by increasing the velocity at which the print head scans over the print media; increased resolution is also often provided by printing smaller ink droplets, closer together.

However, for very high speed printing, particular at increasingly fine resolutions, ink jet printers have been found to exhibit a characteristic that limits print quality. It is believed that upon ejection of a droplet from an ordinary orifice, a tail portion of the droplet may lag the head or main droplet portion. As the elongated droplet proceeds from the print head to the media sheet, surface tension may cause the droplet to break into a main droplet and a separate satellite droplet. With moderate scan rates, this is not a concern, as the satellite strikes the media within the larger spot formed by the main droplet; even if it is not concentric with the main droplet, it is obscured by the larger main spot. However, as scan rates increase, the second droplet strikes increasingly farther from the center of the main spot. This can lead to elongated spots which exhibit an apparent lobe on one side formed by the tail droplet. At still higher scan rates, a separate spot is formed by the satellite droplet apart from the main spot. This reduces image quality by making sharp lines appear fuzzy or jagged, and by adding to locations where it is not intended. This issue is discussed in U.S. Pat. No. 5,369,428 to Maze et al. Which is incorporated herein by reference.

This problem with high speed printing is worsened with smaller ink drop volumes required for higher resolution printing. Instead of causing a proportionate reduction of main and tail drop portions, drop volume reduction has been found to primarily reduce the main droplet portion, without affecting tail droplet volume appreciably. Thus, any undesired printing artifacts generated by offset tail spots will be more noticeable and objectionable relative to the main droplets for higher resolutions than they would be for lower resolutions.

The present invention overcomes the limitations of the prior art by providing a method of ink jet printing including positioning an ink jet print head having a number of nozzles adjacent a sheet of printer media, and moving the sheet or the print head along a scan axis. An ink droplet is expelled from one of the nozzles in an ejection direction offset from perpendicular to the scan axis. The droplet may have a main portion and a tail portion having different velocities and directions, with these parameters and the rate of scanning selected so that both portions strike the same location on the media sheet.

DETAILED DESCRIPTION OF A PREFERRED EMBODIMENT

Figure 1:
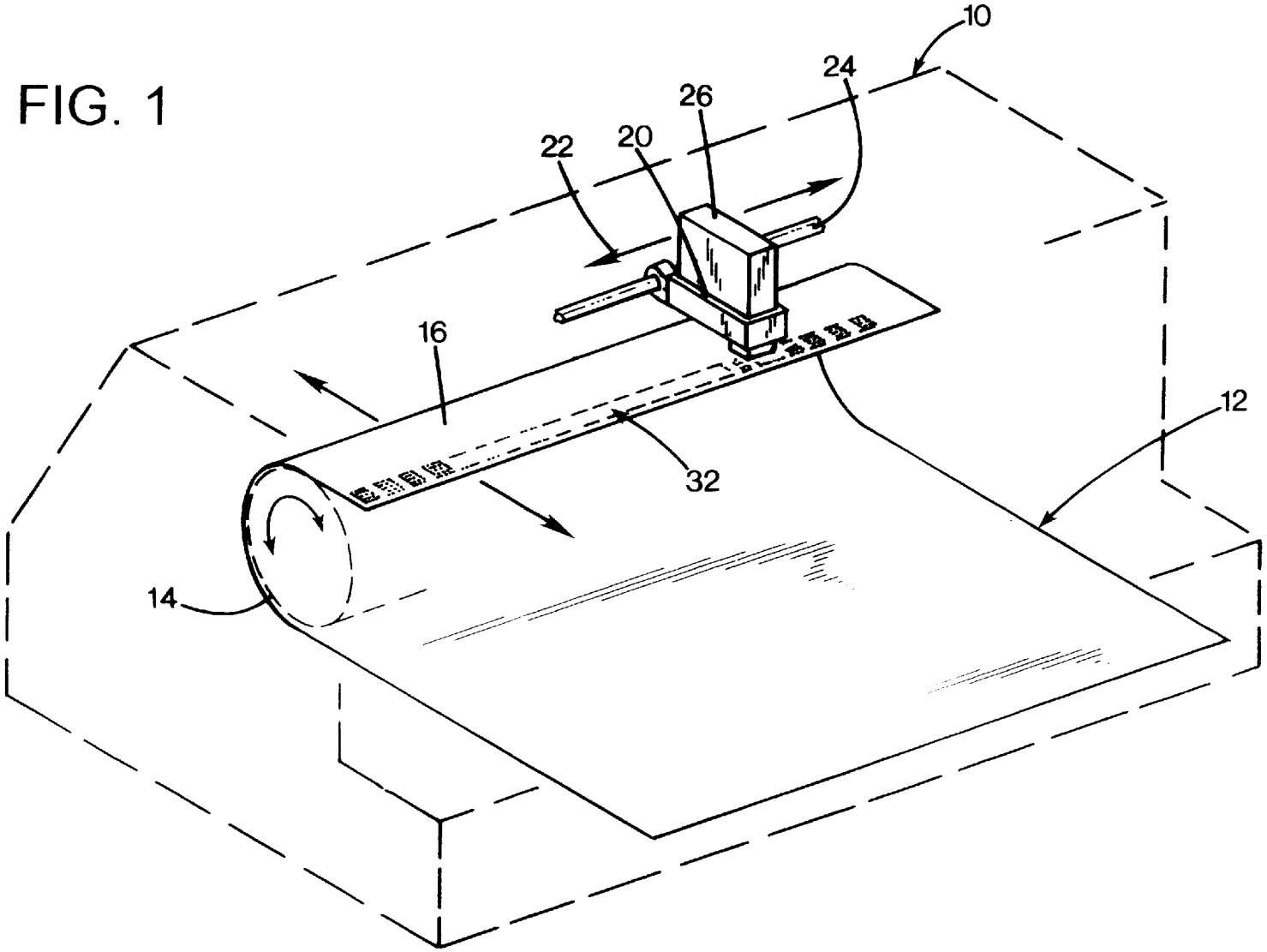
FIG. 1 is a perspective view of a printer according to a preferred embodiment of the invention.

FIG. 1 shows an ink jet printer 10 into which a sheet of printer media 12 has been loaded. The printer has a media drive mechanism 14 that feeds the sheet along a paper or media path, with motion of the sheet defining a feed axis 16. A print head carriage 20 reciprocates along a scan axis 22 on a guide rod 24, and carries a print cartridge 26 that expels ink droplets onto the media surface to generate a desired printed image 32.

Figure 2:
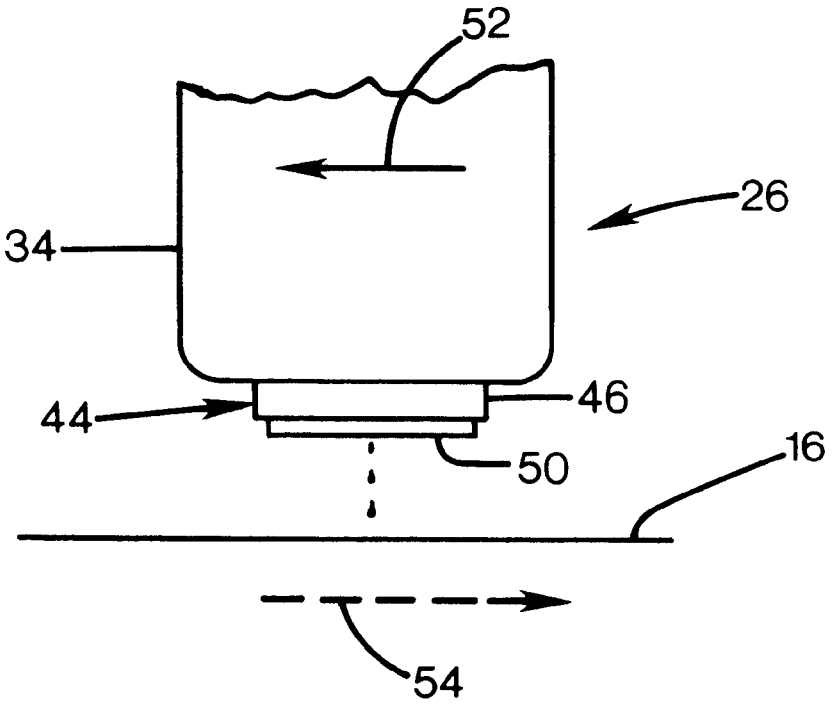
FIG. 2 is an enlarged side view of a print head from the printer of FIG. 1.

FIG. 2 shows the print cartridge 26 in greater detail. The cartridge includes a rigid housing 34 defining an ink chamber containing a supply of ink or connected to a remote supply of ink. A print head 44 encloses the lower portion of the housing, and is connected to the ink supply. The print head includes a silicon die 46 having ink channels and containing firing resistors for a thermal ink jet pen. An orifice plate 50 covers the exposed surface of the die and defines finely spaced arrays of nozzles or orifices through which ink is expelled. The print head operates by activating resistive heaters on the die, each associated with an orifice to generate a steam bubble to displace ink from the nozzle and to expel it onto the sheet 16.

During normal printing in the preferred embodiment, the print head translates only in a single scan direction 52 parallel to the scan axis. For a multi-swath sheet printer using a conventional reciprocating carriage and media transport mechanism, the carriage alternates printing strokes in the scan direction, and retraction strokes in opposite direction to prepare for the next printing swath. To expedite printing, the retraction stroke may be made at high accelerations, and need not be at a constant velocity normally required for printing.

In alternative embodiments, the media may be moved relative to a print head that does not move along the scan axis. In such cases, the media is moved in a counter scan direction 54 parallel to the scan axis, and opposite to the scan direction 52 used in scanning-head printers. As in the preferred embodiment, printing occurs only when motion in this direction occurs. Such printers that move the media to generate the relative scanning motion have several alternative implementations.

For instance, they may be used for generating limited height swaths of printing, such as a single line of text on postal envelopes shuttled past the printer, on products on an assembly line, and the like. Also, such a printer may have several print heads offset from each other perpendicularly to the scan axis, so that each prints a swath adjacent to the next. Such printers may be used for printing multi-line envelope labels, with the print swath limited only by the number and size of print heads. For extremely high speed printers, a page-wide array of print heads may operate to provide single direction printing.

For sheet printers with a single print head, and media motion providing the scanning required, the paper may reciprocate, or any other means of bringing the leading edge of the paper back to a location beneath the print head for a subsequent swath may be employed.

Figure 3A:
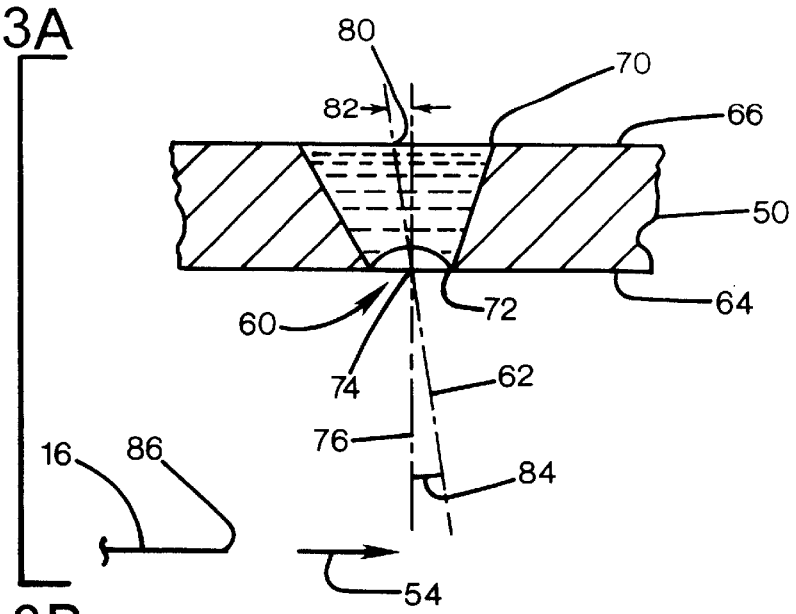
FIGS. 3A–3F are side views showing a sequence of operations.

As shown in FIG. 3A, the orifice plate 50 defines an orifice 60 having a critical shape to provide the necessary droplet directions and velocities. In the illustrations of FIGS. 3A–3F, a moving media embodiment is shown with media moving in the counterscan direction 54 from left to right. However, the principles illustrated may apply as well in the preferred embodiment in which the media is fixed in the scan axis, and the print head is moved from right to left in the illustrations. A print head orifice plate as shown would be suitable for either embodiment.

The orifice is a conical bore having an orifice axis 62 angularly offset from perpendicular to the plane of the plate. The plate has a exterior surface 64 facing and parallel to the media 16, and an interior surface 66 facing the body of the print head, and exposed to a supply of ink. The orifice has an inlet aperture 70 at the interior surface, and an outlet aperture 72 at the exterior surface. The center 74 of the outlet aperture defines a normal axis 76, and the center 80 of the inlet aperture is offset from the normal axis by an offset amount 82. The normal axis and the orifice axis 62 intersect at the center 74 of the outlet aperture, and are angularly offset from each other by an offset angle 84. The orifice axis offset angle is offset in a direction in the counterscan direction 54 in this embodiment with moving media, and the axes occupy a plane perpendicular to the orifice plate and parallel to the scan axis.

Figure 3B:
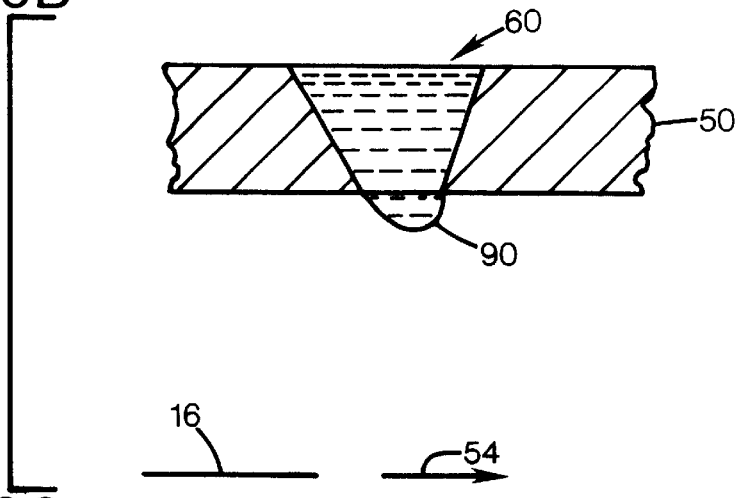

FIGS. 3A–F show a sequence of operation, simplified to show a single droplet being printed. In FIG. 3A, the leading edge 86 of media sheet 16 approaches the idle nozzle. In FIG. 3B, the print head's resistive heater has generated a bubble in a firing chamber (not shown) above the orifice plate, and a drop of ink 90 is being ejected from the outlet aperture 72. Because FIG. 3B represents an interval of time after FIG. 3A, the media sheet has advanced an increment in the counterscan direction 54.

Figure 3C:
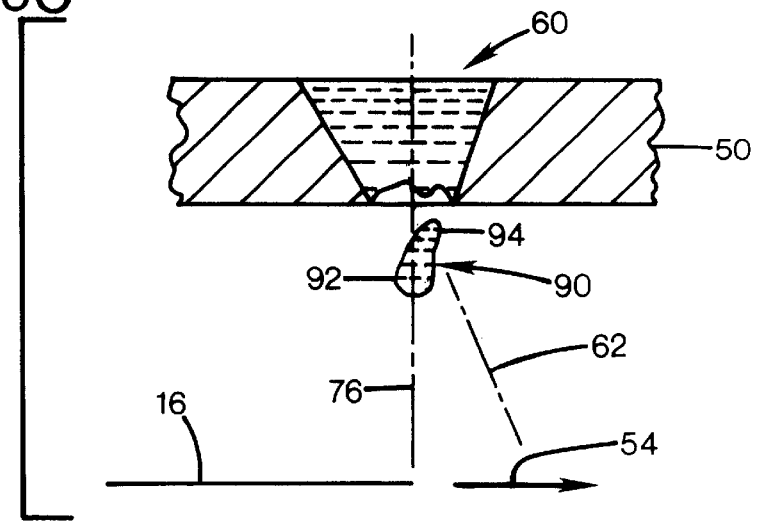

In FIG. 3C, the sheet has further advanced, and the droplet 90 has separated from the irk supply remaining in the orifice. The drop 90 reflects an elongated shape, with a main leading portion 92 extending toward the sheet in a nearly vertical direction approximately along axis 76. A tail portion 94 extends toward the orifice, and angled in the counterscan direction, so that it is aligned approximately with axis 62. It is believed that the initial quantity of ink ejected, which forms the main portion 92 is little affected by the angled shape of the orifice because it resided immediately at the outer aperture prior to ejection, unaffected by the deeper geometry of the orifice. The tail portion, however, follows an angled path, which is believed to be caused by it having resided deeper in the orifice, and having been forced to follow an angled path to exit the orifice. This lateral momentum is believed to continue to impart a lateral velocity component to the tail portion.

In alternative embodiments, the main portion need not follow a precisely vertical track; the droplets need only follow different angled tracks.

Figure 3D:
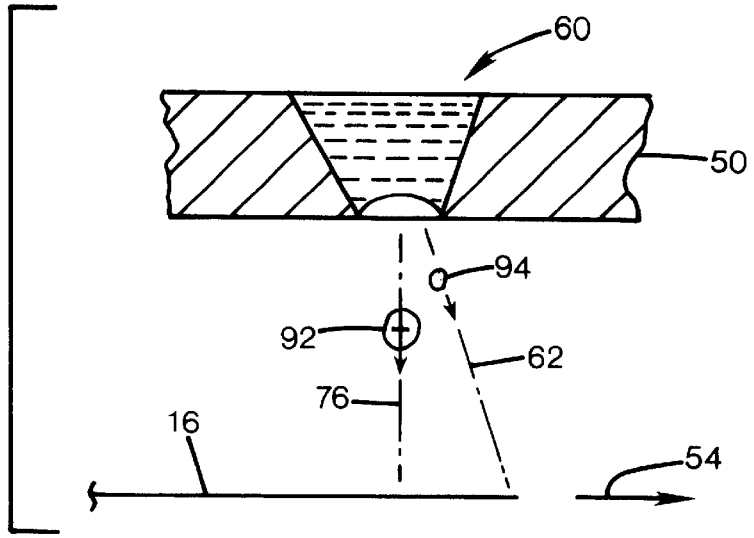

As shown in FIG. 3D, the drop has separated, and the main droplet 92 is following a separate path from the tail droplet portion 94. It is believed that the forces of surface tension cause the elongated droplet to have separated into two droplets. Also, the main portion traveling at a faster velocity than the tail portion will have caused the stretching and led to the separation. Consequently, as illustrated by the velocity vectors associated with the droplet portions, the main droplet has a greater absolute velocity than the tail droplet, and travels on a different angular path. The tail droplet follows a path nearly coincident with the axis 62 for some possible orifice geometries, and is aimed in the direction the media is heading (or in a direction opposite from the scanning direction of the print head in carriage scanning printers).

Figure 3E:
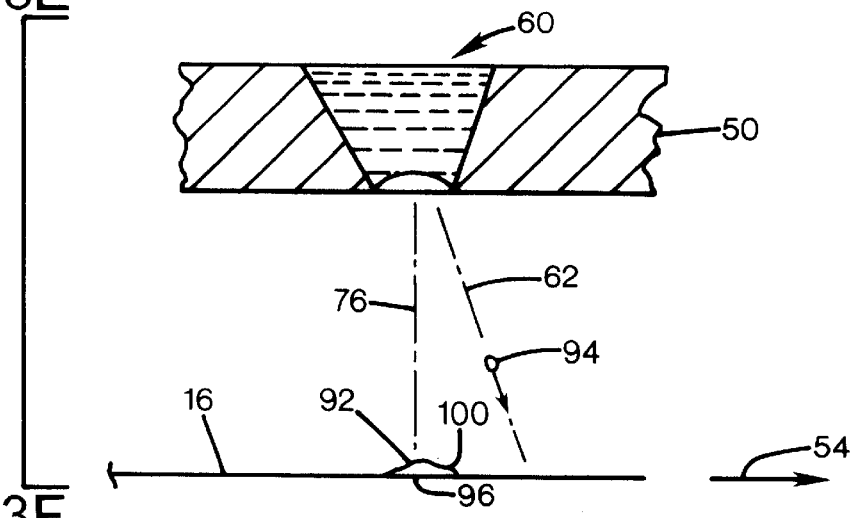
Figure 3F:
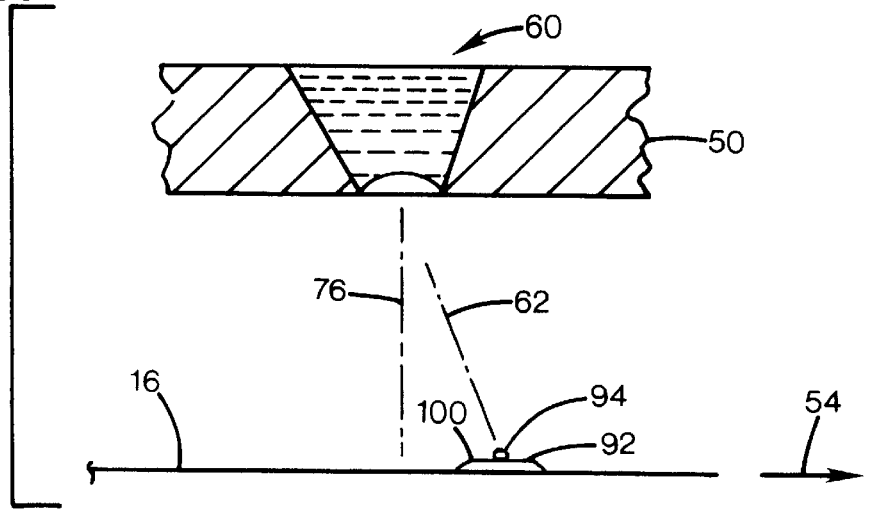

Proceeding to FIG. 3E, the sheet has further advanced, and the main droplet portion 92 has struck the sheet at a target location 96, which in earlier views would have been to the left of the position shown. The drop 92 thus forms a spot 100 on the sheet. The slower-moving tail droplet portion 94 is aimed at the point where the spot will be when the tail droplet strikes the media surface, as shown in FIG. 3F.

Thus, the tail droplet is slower, and must be "aimed" well ahead (in the direction of media motion) so that it arrives at the same location as where the main droplet will have already arrived on a more direct (closer to perpendicular) and rapid path. Similarly, in a scanning-carriage printer, the tail droplet must be aimed in the direction opposite to the carriage motion direction, as if to aim it rearward to strike the spot formed by the faster main droplet. For this to be operable, the droplet velocity should be significantly greater than the scan velocity.

The main droplet need not be closer to the perpendicular, however. In alternative embodiments, the main droplet may be aimed at a position ahead of the carriage and fired at a high velocity, with the tail droplet following a more direct and slow path to hit the same spot. This is analogous to a war plane strafing then bombing a target: high speed projectiles fired at a large angle from vertical, with slower projectiles dropped on a more vertical path. In either embodiment, the faster droplet is fired in a direction that is more "up-media" (i.e. in the direction from which the unprinted media appears to approach the print head.) The slower droplet is angularly offset from the faster droplet's path in a "down-media" direction (toward the printed portion of the media.)

The speed and direction of each droplet, the scan rate of the media or carriage, and the distance between the orifice and the media plane are variables that must be controlled to i5 provide aligned printing of main droplets and tails. The tail droplet need not strike in perfect concentric alignment for ideal printing results. With a larger main spot of radius "R" and smaller tail spot of radius "r", the center-to-center offset between the spots may be up to R-r. At the limit of R-r offset, the smaller spot is entirely circumscribed and internally tangent to the larger spot.

Let the following parameters be defined as:

$\theta_m$=angle from perpendicular for the main drop $\theta_t$=angle from perpendicular for the tail drop $v_m$=velocity of the main drop $v_t$=velocity of the tail drop $V_s$=scanning velocity of the printhead h=distance between the orifice and the media Δ=distance between the centers of the main and tail drops on the media.

$$\text{Then: } \Delta = [v_m \cdot \sin(\theta_m) + v_s] \cdot \left[\frac{h}{v_m \cdot \cos(\theta_m)}\right] - [v_t \cdot \sin(\theta_t) + v_s] \cdot \left[\frac{h}{v_t \cdot \cos(\theta_t)}\right]$$

Additionally, if the main and tail drops form dots on the printing media with radii as follows:

$r_m$=radius of the main dot $r_t$=radius of the tail dot

Then, the tail drop will be hidden within the perimeter of the main drop if: $\Delta \leqq r_m - r_t$ A preferred embodiment would be:

Scan Velocity: −0.5 m/s (the negative sign indicates the scan direction is opposite the direction the nozzle is pointing)

Main Drop Velocity: 14 m/s

Main Drop Angle: 1 deg

Tail Drop Velocity: 10 m/s

Tail Drop Angle: 2 deg

Spacing from orifice to media: 0.00127 m (1.27 mm)

Total Drop Volume: 32 pl

Main Dot (on media) Radius: 25 micron (0.000025 m)

Tail Drop Volume: 10 micron (0.000010 m)

Resolution (DPI): 600

Pixel size: 42.3×42.3 micron (a 600 DPI square)

For the above embodiment, the approximate distance between the center of the main and tail drops on the paper is 4 microns. Since this is less than 15 microns (the difference between the radius of the main and tail drops) then the tail drop is hidden. Note that if the printhead were scanned in the opposite direction, the main and tail drops would be approximately 40 microns apart and the tail would be clearly visible.

Figure 4:
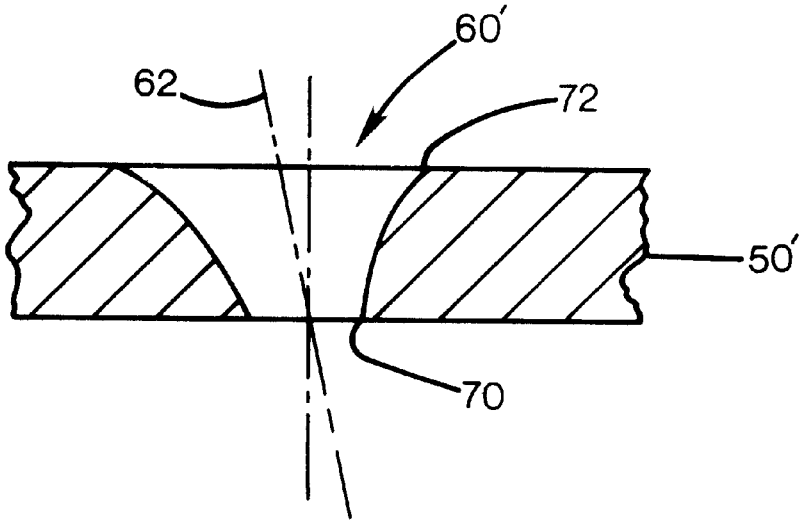
FIGS. 4 and 5 show alternative print head configurations.
Figure 5:
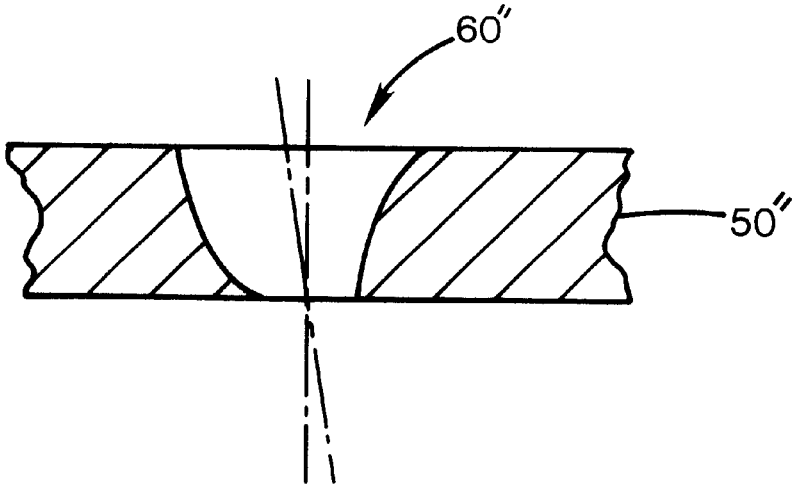

FIGS. 4 and 5 show alternative orifice plates 50', 50", with different orifices 60', 60" configured to control the speed and angle of droplet ejection. In FIG. 4, the orifice has a flared shape having a progressively increasing slope angle from the normal as it progresses from the outer aperture 72 to the inner aperture 70. At each level through the plate 50, the bore has a circular cross section centered on an angled bore axis line 62. In FIG. 5, however, the circular cross sections are centered on a curved line, so that one side is convexly curved and the other concavely curved.

In any embodiment, the nozzles are offset from the vertical, or have some other eccentricity that generated the different droplet angles and velocities required. The nozzles may be formed in a conventional Kapton film serving as the orifice plate by laser drilling or ablation, with the laser or film held at an angle so that the laser does not strike the film perpendicularly. Masks are employed to focus lasers and to control the size and pattern of the hole to be drilled. These masks employ concentric circular patterns that controllably diffract the laser light. To form the angled, offset, or otherwise eccentric orifices, the mask may be provided with non circular ring patterns, and/or rings that are eccentrically positioned with respect to each other so that gaps between encompassing rings are wider on one side than on the other.

While the above is discussed in terms of preferred and alternative embodiments, the invention is not intended to be so limited.

What is claimed is:

1. A method of ink jet printing comprising the steps:

providing a sheet of printer media;

providing an ink jet print head adjacent the sheet and defining a plurality of nozzles;

moving the media sheet in a counterscan direction relative to the print;

generating a droplet having a main portion and a tail portion, and expelling the portions in different directions, with the tail portion being expelled in a direction angularly displaced toward the counterscan direction from the direction of the main portion; and printing only when the sheet is moving in the counterscan direction.

2. An ink jet printing apparatus for generating an image on a media sheet, the apparatus comprising:

a body defining a media path;

a print head connected to the body, the printhead including an orifice member defining the orifices and having opposed major surfaces, each orifice having an inlet at one of the surfaces and an outlet at the other of the surfaces, the inlet and outlet being offset from each other;

a scan mechanism operable to move at least one of the print head and a media sheet residing in the media path, to generate relative scanning movement between the print head and the media sheet in a scan axis direction;

the print head defining a plurality of ejection orifices; and each of at least some of the orifices including directional means for ejecting a first droplet portion at a first velocity and a first direction, and a second droplet portion at a different second velocity and different second direction.

3. The apparatus of claim 2 wherein the inlet and outlet are offset along a line parallel to the scan axis.

4. An ink jet printing apparatus for generating an image on a media sheet, the apparatus comprising:

a body defining a media path;

a print head connected to the body;

a scan mechanism operable to move the media along the scan axis with respect to the print head in a scan axis direction;

the print head defining a plurality of ejection orifices; and each of at least some of the orifices including directional means for ejecting a first droplet portion at a first velocity and a first direction, and a second droplet portion at a different second velocity and different second direction.

5. The apparatus of claim 4 including control means for limiting operation of the print head to periods when the media is moving along the scan axis only in a first direction.

6. An ink jet printing apparatus for generating an image on a media sheet, the apparatus comprising:

a body defining a media path;

a print head connected to the body;

a scan mechanism operable to move the print head along the scan axis with respect to the media in a scan axis direction;

the print head defining a plurality of ejection orifices; and each of at least some of the orifices including directional means for ejecting a first droplet portion at a first velocity and a first direction, and a second droplet portion at a different second velocity and different second direction.

7. The apparatus of claim 6 including control means for limiting operation of the print head to periods when the print head is moving along the scan axis only in a first direction.

* * * * *